United States Patent [19]

Ross

[11] Patent Number: 4,960,401

[45] Date of Patent: Oct. 2, 1990

[54] SPINNING TOP TOY

[76] Inventor: Bruce Ross, 8 Kiska Ct., Randallstown, Md. 21133

[21] Appl. No.: 450,563

[22] Filed: Dec. 14, 1989

[51] Int. Cl.[5] ..... A63H 1/00

[52] U.S. Cl. ..... 446/256; D21/95

[58] Field of Search ..... 446/256, 257, 258, 259, 446/260, 261, 262, 263, 264; D21/95–97

[56] References Cited

U.S. PATENT DOCUMENTS

| | | | |
|---|---|---|---|
| D. 255,470 | 6/1980 | Johnson | D21/96 |
| 547,764 | 10/1895 | Boyum | 446/256 |
| 2,464,994 | 3/1949 | Roseen | 446/256 |
| 2,638,706 | 3/1953 | Seale | 446/256 |
| 2,879,066 | 3/1959 | Sutherland | 446/256 X |
| 3,114,986 | 12/1963 | Blonski | 446/258 |

FOREIGN PATENT DOCUMENTS

| | | | |
|---|---|---|---|
| 634937 | 3/1950 | United Kingdom | 446/256 |

*Primary Examiner*—Mickey Yu

[57] ABSTRACT

A spinning top toy having minimal size and weight which when used in combination with a familiar commonplace coin exhibits significantly improved spinning and balancing properties. The toy can also be spun on its edge so that it can be raced across a flat surface.

2 Claims, 1 Drawing Sheet

SPINNING TOP TOY

BACKGROUND

1. Field of Invention

This invention relates to spinning top toys, specifically to those which are spun using the fingers of one hand.

2. Description of Prior Art

Spinning top toys have been enjoyed by young and old for generations. For this reason, there have been a number of commercially successful spinning top toys.

Heretofore, a wide variety of spinning top toys have been proposed and implemented. However, there have been few significant improvements in this crowded art which have caught the imagination of users and provided surprising, exciting, and intriguing performance.

In order to function well, spinning top toys need to be able to maintain their balance at relatively low speeds of rotation achieved when spun with the fingers of one hand. Prior art devices accomplished this by including significant mass as an integral part of their structures.

The additional size, weight and material required by this structural mass is a formerly unrecognized problem which increases the manufactured cost of these devices.

Another problem is that the structure of prior art devices precludes any possibility of the user being surprised. That is, a user will immediately recognize a prior art device as a top structure and as a result of handling and observing its size, weight, and balance will expect such device to readily spin.

In addition, no prior art device was constructed so that it could perform alternatively as a racing toy.

Most manufacturers and users of spinning top toys would therefore find it desirable to have a spinning top toy which required a minimum of size, mass and material to produce and provided users with surprising, exciting and intriguing performance.

OBJECTS AND ADVANTAGES

Accordingly, several objects and advantages of my invention are:

(a) to provide a spinning top toy with minimal structural size and weight in order to minimize the cost of manufacture;

(b) to provide a spinning top toy that when combined with familiar commonplace coin will create a synergism. That is, the combination produces surprising, exciting and intriguing spinning performance which is superior to the sum of the spinning abilities of either the spinning top toy or said coin;

(c) to provide a spinning top toy which can be spun on its edge so that it will race across a flat surface. This is a heretofore unrecognized form of play for spinning top toys which allows users to play competitive racing games. The low mass of this invention and its continuous circular edge allow the combination of said coin spinning top toy to roll unimpeded on said edge in a balanced, straightforward and prolonged manner.

Further objects and advantages of my invention will become apparent from consideration of the drawings and ensuing description of it.

DRAWING FIGURES

Figure 1:
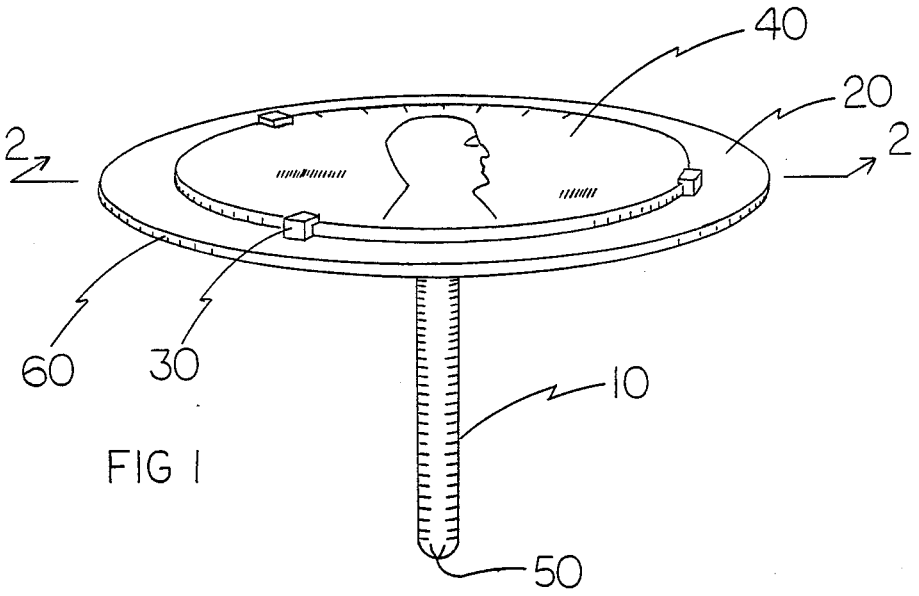
FIG. 1 shows a perspective view of an embodiment of the spinning top toy of this invention used with a coin.

10 spindle means
20 mounting means
30 mounting clips
40 coin
50 pivot point
60 edge

Spinning Top Toy—Description

FIG. 1 shows a spinning top toy according to a preferred embodiment of this invention. The lightweight spinning top toy is preferably constructed as a single piece of molded plastic. A spindle means 10 having a pivot point 50 at one end is used for spinning with the fingers of one hand. The spindle means 10 shown in FIGS. 1 and 2 and a mounting means 20 are continuously molded. The mounting means 20 is constructed at the end of said spindle means 10 opposite the pivot point 50.

In this embodiment, the mounting means 20 removably holds, supports, orients, and aligns a coin 40 so that the axis of symmetry of the coin face is in alignment with the axis of rotation of said spindle means 10. Mounting clips 30 are used to secure said coin 40 in position. The edge 60 is smooth and circular.

Spinning Top Toy—Operation

Figure 2:
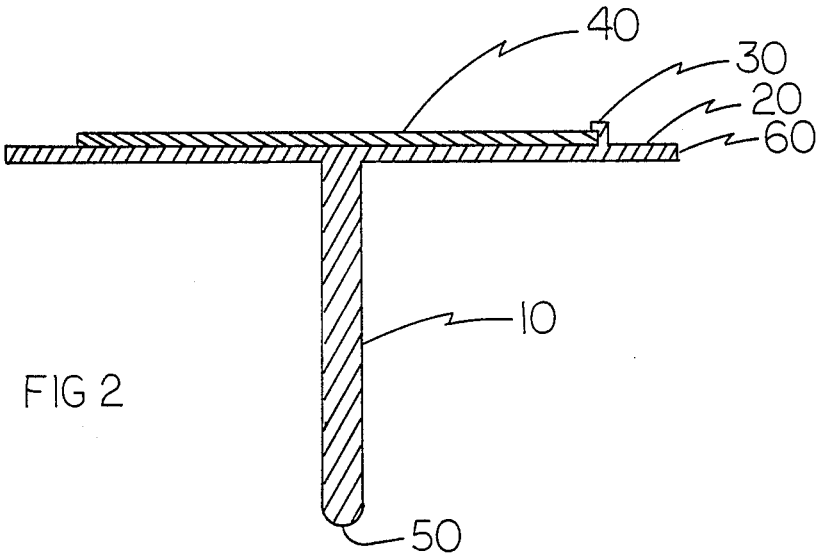
FIG. 2 shows a sectional view of such spinning top toy along section line 2—2 of FIG. 1.

To operate the embodiment of this invention shown in FIGS. 1 and 2, a user must first snap a coin 40 into the mounting means 20 so that the edge of said coin 40 is secured under said mounting clips 30. This assembly ensures that the axis of symmetry of the coin face is aligned with the axis of rotation of said spindle means 10.

Holding the spinning top toy in the upright position as shown in FIGS. 1 and 2, the user would spin the spindle means 10 with the fingers of one hand and release said top allowing the rotating toy to drop to a smooth surface such as a floor or table top.

With a coin 40 securely placed in said mounting means 20 as described above, the spinning top toy will spin in a balanced and prolonged manner.

The synergism between the spinning top toy and the coin 40 can be demonstrated by removing said coin 40 and attempting to spin said invention as described above. Without the coin 40 in place in said mounting means 20, the lightweight spinning top toy will fail to spin. Likewise, it will be equally difficult to spin the coin 40 in this fashion.

Another surprising result can be obtained by spinning the invention so that the axis of rotation of said spindle means 10 is held horizontally. Upon release, the spinning top toy will roll on its edge 60 across said floor or table top. Users will find much enjoyment racing several spinning top toys in this way.

Conclusion, Ramifications, and Scope of Invention

Thus, the reader will see that the spinning top toy of this invention provides an inexpensive, light weight device with surprising an.,d exciting synergistic spinning qualities when used with a familiar commonplace coin. Also, said combination can be used as a racing toy.

While my above description includes many specificities, the reader should not construe these as limitations on the scope of the invention, but merely as exemplifications of preferred embodiments thereof. Those skilled in the art will envision many other possible variations that are within its scope.

For example, skilled artisans will readily be able to change the dimensions and shapes of the various embodiments. They will also be able to make the spinning top toy of alternative lightweight materials.

They can make many variations of the size and shape of both the spindle means 10 and mounting means 20. The mounting means 20 can be constructed to hold a variety of different, familiar commonplace coins. Also, the mounting clips 30 can be made in various ways or in some constructions can be eliminated entirely by using an adhesive.

Mass and material usage can be optimized by using various types of construction techniques. For example, the mass of the mounting means 20 shown in FIGS. 1 and 2 can be reduced by symmetrically perforating said mounting means 20. Another possible construction is to shape the mounting means 20 to resemble a spoked wheel. The smooth circular outer edge 60 can be reduced in diameter.

Accordingly, the reader is requested to determine the scope of the invention by the appended claims and their legal equivalents, and not by the examples which have been given.

I claim:

1. A lightweight spinning top structure, comprising:

a spindle means, having a pivot point at one end, for spinning said spinning top structure with the fingers of one hand and, mounting means, attached to said spindle means for removably holding, supporting, orienting and aligning a coin, whereby the axis of symmetry of said coin is aligned with the axis of rotation of said spindle means, whereby the synergism of combining said lightweight spinning top structure and said coin provides the ability for the combination to spin in a prolonged stable manner.

2. The spinning top structure of claim 3 wherein said mounting means has a smooth, circular outer edge whereby said toy can be spun so that it rolls on said edge.

* * * * *